United States Patent [19]

Stevens et al.

[11] Patent Number: 4,697,544

[45] **Date of Patent: * Oct. 6, 1987**

[54] DISPOSABLE SPRAY SHIELD

[76] Inventors: Keith A. Stevens, 4412 E. Mulberry #195; Daniel R. Stevens, 2841 Stanford Rd.; Howard Stevens, Jr., 2731 Stanford Rd., all of Fort Collins, Colo. 80525

[ * ] Notice: The portion of the term of this patent subsequent to Mar. 11, 2003 has been disclaimed.

[21] Appl. No.: 826,081

[22] Filed: Feb. 4, 1986

Related U.S. Application Data

[63] Continuation-in-part of Ser. No. 687,831, Dec. 31, 1984, Pat. No. 4,574,731.

[51] Int. Cl.[4] ..... B05C 21/00

[52] U.S. Cl. ..... 118/504; 29/400 D

[58] Field of Search ..... 118/504; 29/400 D

[56] References Cited

U.S. PATENT DOCUMENTS

| | | | |
|---|---|---|---|
| 4,085,703 | 4/1978 | Glowacki | 118/504 |
| 4,248,914 | 2/1981 | McClane | 427/282 |
| 4,398,495 | 8/1983 | Harris et al. | 118/504 |
| 4,574,731 | 3/1986 | Stevens et al. | 118/504 |

*Primary Examiner*—John P. McIntosh

*Attorney, Agent, or Firm*—James R. Young

[57] ABSTRACT

A disposable spray shield has a thin, planar sheet of large surface area fabricated with an inexpensive, semi-rigid material, such as cardboard, formed with a structural reinforcing rib along its rear edge. The rib can be used as a handle in combination with a hand hole through the sheet adjacent the rib, or, preferably, a removeable handle is included for removeable attachment to the disposable spray shield. The rib is preferably formed from a portion of the planar shield sheet folded into an elongated, three-dimensional configuration and the handle has clamping jaws and mating surfaces that engage the rib. Disposable handles are also provided as an alternative.

30 Claims, 29 Drawing Figures

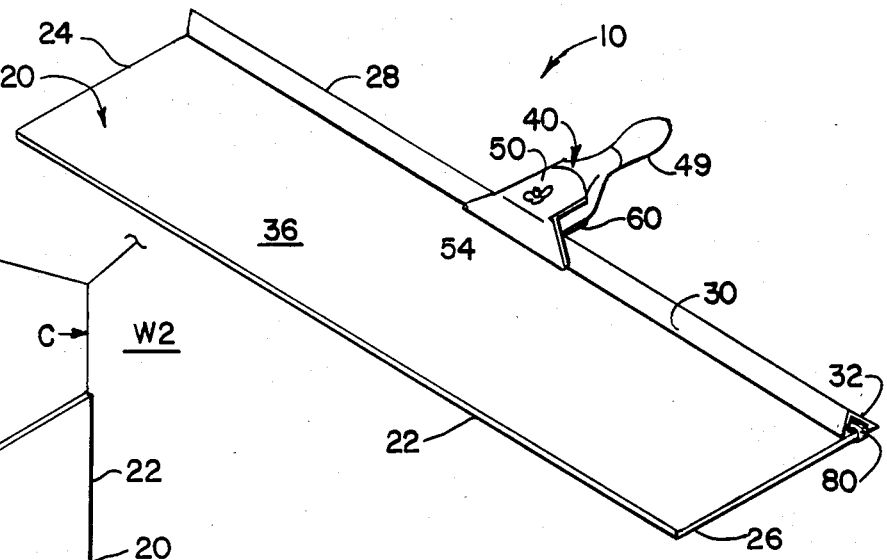
FIG. 1
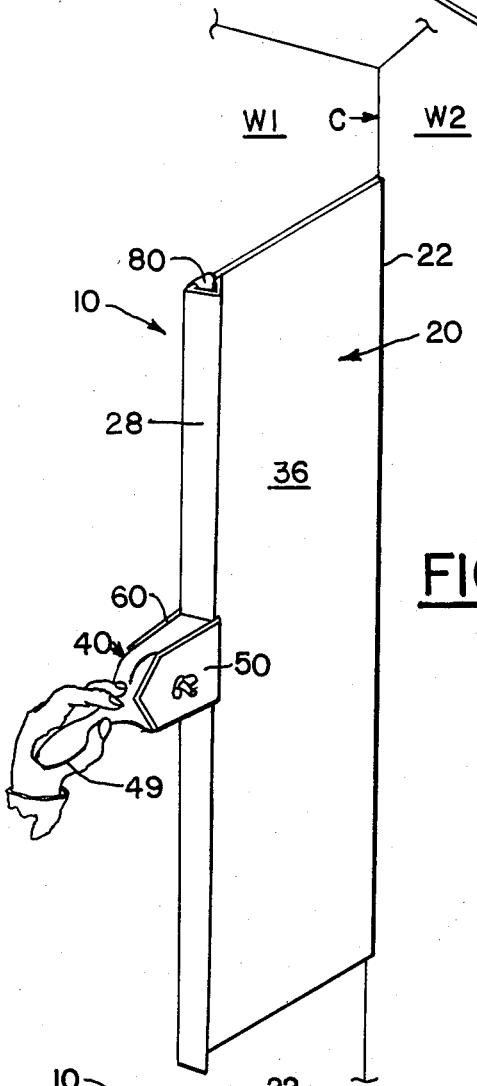
FIG. 2
FIG. 3
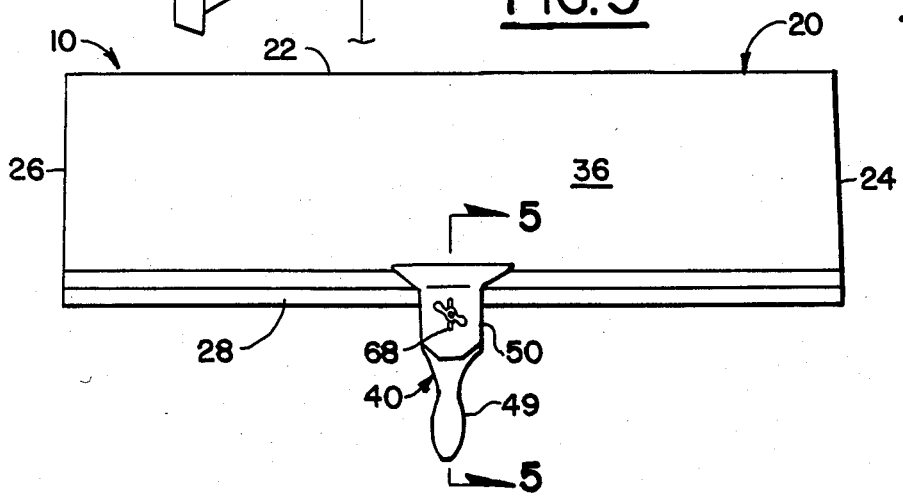
FIG. 4
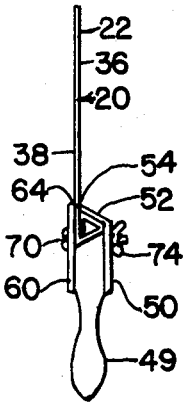

DISPOSABLE SPRAY SHIELD

CROSS-REFERENCE TO RELATED APPLICATION

This patent application is a continuation-in-part of the patent application Ser. No. 687,831, filed Dec. 31, 1984 now U.S. Pat. No. 4,574,731.

BACKGROUND OF THE INVENTION

1. Field of the Invention

The present invention is related generally to hand tools, and more specifically to a disposable spray shield for use by painters and the like to prevent overspray onto areas adjacent surfaces being sprayed.

2. Description of the Prior Art

Spray guns and aerosols of various kinds are very practical devices for applying paints, adhesives, architectural texturing materials, and the like to surfaces. Spray applications of such materials are much faster and more economical than conventional hand application techniques, and, in some spraying provides a more pleasing or desired functional or visual effect of the sprayed material. However, a pervasive problem in the use of such spray techniques is that a spray pattern by its nature, is not precise. While the main spray pattern is directed at the area to be sprayed, some of the material around the periphery of the pattern drifts or mists over a wider area. Such mist or particles or droplets of the sprayed material around the periphery of the targeted area is know as "overspray." Thus, when the surface to be sprayed is adjacent an area or surface not to be sprayed, it is necessary to mask or shield such area or surface not to be sprayed form the material overspray.

One conventional method of protecting adjacent surfaces from such overspray is to mask the area to be protected with a covering or adhesive tape or the like. Such masking is effective, but it is very time-consuming. Also, there are situations, such as where carpet meets a baseboard to be sprayed, where effective masking is very difficult, if not impossible.

Another conventional technique, more significant to this invention, is the use of a large portable shield that can be positioned at the edge of the surface to be sprayed in order to cover or protect the adjacent surface that is not to be sprayed. There are available hand-held portable shields for such use. Such hand-held shields in use such as spray painting or applying texturing materials to walls and ceilings, have to have a significantly large surface area, usually in the range of three or more square feet, in order to effectively prevent overspray from spray guns. To be effective and useable, such shields have to be light weight, so they can be held in one had by the user, sometimes in awkward or outstretched arm positions. Yet, they must be structurally rigid to maintain a planar shape and a straight leading or "cutting" edge for defining a sharp, straight line or edge at the border of the surface being sprayed. In order to provide sufficient structural rigidity to such a large surface area, yet to maintain the necessary thinness, light weight and maneuverability requirements, such spray paint shields are conventionally fabricated with a flat, thin metallic sheet such as steel or aluminum alloy with a handle attached thereto for gripping and manipulating the shield. While such conventional metallic shield devices do perform the shielding function for which they are intended, there are a number of problems associated with their use that have not heretofore been solved. First, they are still heavier and more tedious to hold over extended periods of time than desirable. Second, the materials being sprayed, such as paints, glues, and texturing materials, have some adhesive characteristics. Therefore, use of the shield over an extended period of time will result in a substantial build-up of the sprayed material on the exposed surface of the shield. The build-up of such material becomes very heavy and unwieldy for a person to handle. It also distorts the leading edge of the shield and affects the ability of the user to "cut" or define a clear sharp edge or line at the border of the surface being sprayed. Depending to some extent on the adhesive characteristics of the materials being used, it is often difficult and very time-consuming to clean such materials from the shield surface. On the other hand, such conventional metal shields are too expensive to discard them or replace them with new shields. Therefore, as usually happens, a worker spends much more time than should be necessary trying to use a shield that has too much heavy spray material built up on the surface thereof, yet being reluctant to discard the shield and to replace it with a new one. They also tend to spend more time than is economically feasible trying to clean the surfaces of such shields. Further, if the leading or cutting edge of the shield becomes nicked or distorted or deformed in some manner, the accuracy of the edge or line to be cut at the edge of the surface to be sprayed is distorted and becomes undesirable for most uses. Unfortunately, such bending or distortions occur quite frequently in normal use. Therefore, many expensive metal shields with damaged edges or uncleanable build-up on the surfaces have to be discarded, in spite of the expense of purchasing new ones.

As a substitute for the expensive commercial metal shields, some painters or workers attempt to use less expensive materials, such as sheets of cardboard or plastic, for paint shields. However, such materials do not usually have sufficient structural rigidity or strength to maintain a planar shape and a straight leading edge as required for effective spray shields in most applications. They also are not conducive to holding and handling over extended periods of time. Such substitutions are usually not very satisfactory.

Consequently, while the more expensive metal spray shields available are effective when they are new, they lose their effectiveness as material builds on the surface and as the leading edges become damaged or deformed through normal use, yet they are too expensive to throw away. On the other hand, prior attempts to use cheaper materials have not been satisfactory because they are not sufficiently rigid and they do not provide adequate means for holding and manipulating them.

SUMMARY OF THE INVENTION

Accordingly, it is a general object of the present invention to provide a new and improved spray shield that is sufficiently rigid, light weight, and easy to handle to be used effectively for most spray shield applications, while being sufficiently inexpensive to be disposable and replaceable upon acquiring a build-up of the sprayed material on the surface thereof or upon damage or deformation of the leading or cutting edge thereof.

It is a more specific object of this invention to provide a disposable spray shield fabricated of an inexpensive semi-rigid material shaped in such a way as to reinforce the structural rigidity of the spray shield.

It is also a specific object of the present invention to provide such a disposable spray shield with a convenient handle made for holding and manipulating the shield as well as for maintaining the structure of the disposable shield.

It is still another specific object of the present invention to provide a removable or detachable handle for such disposable spray shields.

Another specific object of the present invention is to provide a disposable spray shield fabricated of an inexpensive semi-rigid material and detachable handle means that can be removably attached to the disposable shield at several angles to the plane of the shield for increased convenience and easier manipulation to desired positions during use.

Additional objects, advantages, and novel features of the present invention shall be set forth in part in the description that follows and in part will become apparent to those skilled in the art upon examination of the following or may be learned by the practice of the invention. The objects and advantages of the invention may be realized and obtained by means of the instrumentalities and combinations particularly pointed out in the appended claims.

To achieve the foregoing and other objects and in accordance with the purpose of the present invention, as embodied and broadly-described herein, the apparatus of this invention mnay comprise a flat planar shield fabricated of an inexpensive, semi-rigid material, such as cardboard, with a reinforcing rib formed at the rear edge thereof. The rib is formed by bending the planar sheet into a three-dimensional configuration having a cross-section in the form of a polyhedron or cylinder that resists bending or deformation. A removable handle is equipped with clamping members and abutting surfaces adapted to be attached to the reinforcing rib of the shield. Preferably, the abutting surfaces and clamping members are oriented and shaped to mate with the rib in such a manner that the handle is provided a secure grip on the shield and that the handle helps to maintain the shape and construction of the rib. Additional features and embodiments include the use of cut-outs and to facilitate gripping the rib directly and disposable clips and retainers to maintain the shape of the rib. Optional disposable handles are also provided for the disposable shields and a shape-forming bock for initially shaping the rib as it is formed on the planar sheet is also included.

BRIEF DESCRIPTION OF THE DRAWINGS

The accompanying drawings, which are incorporated in and form a part of the specifications, illustrate preferred embodiments of the present invention, and together with the description serve to explain the principles of the invention. In the drawings:

FIG. 1 is a perspective view of the disposable paint shield according to the present invention with a detachable handle mounting thereon in substantially coplanar orientation with the shield;

FIG. 2 shows the shield of FIG. 1 in a use position with its leading or cutting edge positioned at the intersection or corner of two adjacent wall surfaces;

FIG. 3 is a front elevation view of the spray shield shown in FIG. 1;

FIG. 4 is an end elevation view of the spray shield shown in FIG. 3;

DETAILED DESCRIPTION OF THE PREFERRED EMBODIMENTS

Figure 5:
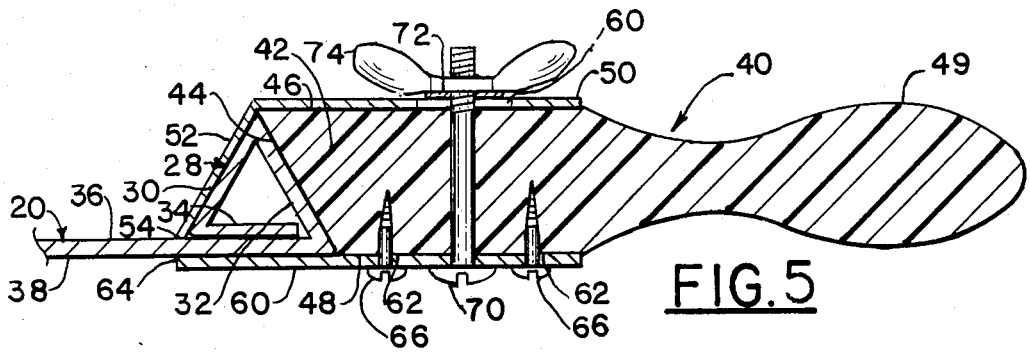
FIG. 5 is an enlarged cross-sectional view of the reinforcing rib of the shield and the clamping handle taken along lines 5—5 of FIG. 3.

The disposable spray shield apparatus 10 according to the present invention is shown in FIGS. 1 through 4. It is comprised generally of a large, thin, planar shield 20 having a handle 40 removably mounted thereon. It is structured to provide a shield against overspray onto adjacent surfaces during the operations of spraying materials such as paint, adhesives, architectural texturing materials, and the like. For example, the shield apparatus 10 is illustrated in FIG. 2 positioned with its forward leading or "cutting" edge positioned in a corner C at the intersection of two adjacent walls W1, W2 in a building. As illustrated in FIG. 2, the disposable shield 20 is positioned to intercept any overspray from a paint spraying gun (not shown) and prevent the spray from contacting the wall W1 during spray painting of the wall W2.

The disposable shield portion 20 is essentially comprised of a large, thin, planar sheet 36 of rigid or semi-rigid material. The material to be used for this shield purpose, is preferably an inexpensive material that is readily disposable, such as cardboard.

As mentioned above, the forward or leading edge 22 is provided for placing against a wall or other object to "cut" or define a line that represents the outer extremities or border of the area or surface on which it is desired to apply a sprayed material, such as paint, adhesive, architectural texturing materials, or the like.

A three-dimensional structural rib 28 extends along the rear edge of the shield 20 for enhancing the structural rigidity and durability of the shield 20. The right and left side edges 24, 26 define the outer lateral extremities of the shield surface 36. It is preferred, although not required, that the rib 28 extend upwardly from the top surface 36 as opposed to the bottom surace 38 of the shield 20 so that the planar bottom surface 38 of the shield remains substantially uninterrupted for placing flat against the wall or other surface to be shielded. A downwardly protruding rib, or a rib that protrudes both upwardly and downwardly, although not preferred, is considered to be an equivalent of the upwardly protruding rib for purposes of this invention.

A significant feature of this invention is the construction of the stiffener rib 28 adjacnet the rear edge of the shield 20. In general, the rib 28 is formed by bending the rear portion of the sheet of the shield 20 out of the plane of the sheet and returning it over the plane of the sheet in such a manner that at least part of the returned portion is positioned a distance spaced above or below said plane. The cross-sectional shape of the rib can be of a number of different geometric variations, as will be described. Generally, the rib will define the shape or surface of an elongated polyhedron or an elongated cylinder. For the purposes of this description and the claims appended hereto, a polyhedron is considered to be a solid bounded by any number of polygons or sides, and a cylinder is considered to be a surface generated by a straight line moving parallel to a fixed straight line moving parallel to a fixed straight line and intersecting a plane curve. However, other variations of rib shapes that could also perform the desired functions of a stiffened disposable spray shield such as conical, frustoconical, or planar ribs extending in planes other than the plane of the sheet will become obvious to persons skilled in the art from the description that follows and are considered to equivalents for purposes of this invention.

Figure 6:
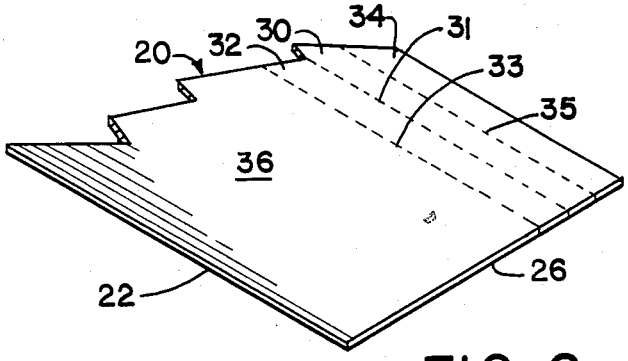
FIG. 6 is an enlarged fragmentary perspective view of one end of the disposbale shield material as it is prepared for shaping into the reinforcing rib configuration according to this invention.
Figure 7:
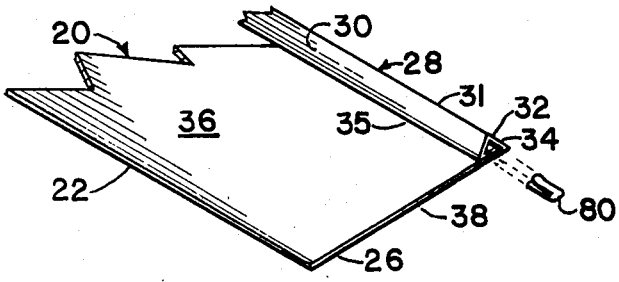
FIG. 7 is an enlarged fragmentary perspective view of the shield end illustrated in FIG. 6 after it is configured with the reinforcing rib, and including a retaining clip for retaining the structure of the reinforcing rib.

Referring now to FIGS. 6 and 7, the spray shield 20 is comprised of a thin planar sheet of semi-rigid material, such as cardboard. The rear portion of the cardboard sheet of the shield 20 is scored or creased in three parallel lines 31, 33, 35, to define three strips or panels 30, 32, 34 of approximately equal width along the length of the shield 20. The sheet is then folded along the scored or creased lines 30, 33, 35, respectively, to form the rib 28 in a three dimensional configuration having a cross section substantially in the shape of an equilateral triangle.

As best shown in FIGS. 5 and 7, a panel 32 forms the rear panel of the rib 28, and panel 30 forms the front panel of the rib 28. Panel 34 is tucked inside the rib 28 to lay on the upper surface 36 of the shield 20. Therefore, the panel 34 in combination with the rear portion of shield 20 forms the bottom of the rib 28. Preferably, a clamp 80 is positioned in the rib 28 over the flap 34 and under the bottom surface 38 of the shield 20 to retain the triangular structure of the rib 28 and hold it from unfolding at the outer edges. In this triangular configuration, the rib 28 provides the additional structural integrity for the shield 20 necessary to hold it in a substantially planar configuration of for use as a spray shield.

As best illustrated in the cross-section of FIG. 5, the handle 40 is comprised of a thickened shank portion 42 with a hand grip portion 49 extending rearwardly therefrom. The shank portion 42 is preferably of a thickness approximately equal to the altitude of the triangular cross section of the rib 28 so that the top surface 46 thereof is aligned with the apex of the rib 28 and the bottom surface 38 of the shield 20. The flat front face 44 of the shank 42 is inclined at an angle of approximately 60° to the top surface 46 and an angle of approximately 120° with the bottom surface 48. This inclined front face 44 is structured to abut against a portion of the rear panel 32 of the rib 28. Therefore, with the handle 40 oriented as shown in FIG. 5, then hand grip portion 49 extends rearwardly from the shield 20 with its longitudinal axis approximately parallel to the plane of the shield 20.

The handle 40 also includes two clamping jaws in the form of a top plate 50 and a bottom plate 60 for engaging the rib 28 and securing it to the shank 42. The bottom plate 60 is fastened to the shank 42 by a plurality of screws 66 extending through holes 62 in the plate 60 and into the shank 42. This bottom plate 60 extends forwardly from the shank 42 to define a platform surface on which the bottom surface 38 of the shield 20 is positioned. This platform surface, therefore, is substantially co-planar with the bottom surface 38 of shield 20 and with the flat bottom surface 48 of the shank 42.

The top plate 50 is releaseably mounted on the shank 42 by a bolt 70 and wing nut 74. The bolt 70 extends through the shank 42 and through a hole 60 in the top plate 50. The hole 60 can be slotted to allow for some adjustment of the top plate 50, if necessary. A lock washer 72 is provided to secure the wing nut 74 in tightened position as the handle 40 is used. The forward portion 52 of the top plate 50 is bent downwardly at the forward extremity of the shank 42 at an angle of approximately 120° to the plane of the top surface 46 of shank 42. This forward portion 52 therefore extends forwardly and downwardly along the front panel 30 of rib 28 to a position adjacent the top surface 36 of shield 20. Therefore, when the top plate 50 is tightened and secured by wing nut 74, as shown in FIG. 5, the triangular con-figured rib 28 is positioned and retained within the triangular housing defined by the bottom plate 60 on the bottom, the flat front face 44 of the shank 42 on the rear, and the forward portion 52 of the top plate 50 on the front, with the planar sheet of the shield 20 extending forwardly through an opening between the forward edges 54, 64, of the top and bottom plates 50, 60, respectively. In this manner, the rib 28 of shield 20 is engaged and retained securely and immovably by handle 40.

It is appropriate to mention that the bottom plate 60 could be an extension of the shank 42. For example, if the shank 42 is a molded plastic part, the bottom plate 60, or the forwardly protruding jaw thereof, can be molded as a unitary part of the shank 42.

Figure 8:
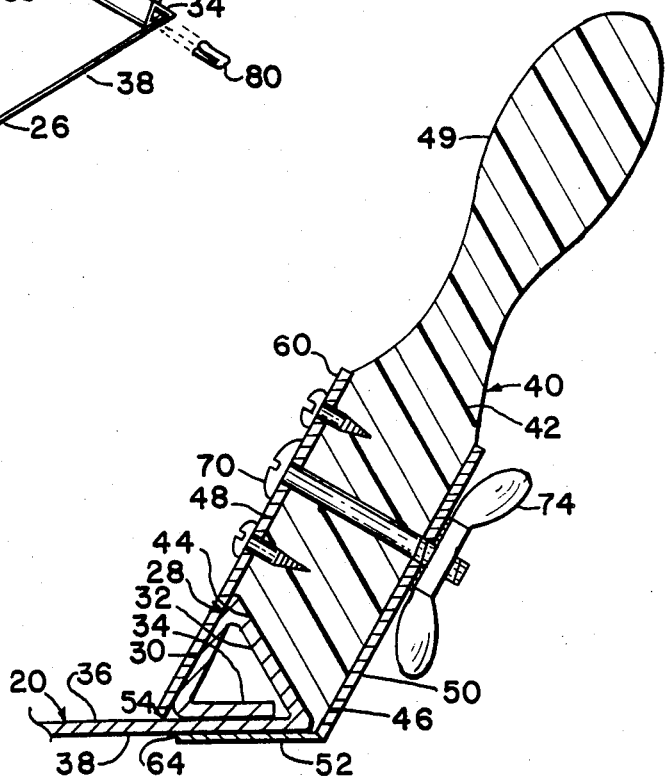
FIG. 8 is an enlarged cross-sectional view of the reinforcing rib of the shield and the removable handle attached in the alternate position at an obtuse angle to the plane of the shield.

Referring now to FIG. 8, it is illustrated that the equilateral triangular cross-section of the rib 28 in combination with the angular relationships of the front face 44, bottom plate 60 and front por2tion 52 of top plate 50, as described above, are conducive to an alternative attachment of the handle 40 in a position extending rearwardly and upwardly at an obtuse angle to the shield 20. In the orientation illustrated in FIG. 8, the handle 40 is turned upside down before it is clamped to the rib 28. Specifically, with the flat front face 44 still abutted against the rear panel 32 of rib 28, the bottom plate 60 extends downwardly adjacent the front panel 30 of the rib 28 so that the surface 48 of the shank 42 is substantially coplanar with the front panel 30 of rib 28. The front portion 52 of top plate 50 then extends forwardly under the bottom surface 38 of shield 20 so that the bottom surface 38 extends forwardly from the handle 40 at an angle of approximately 120° from the surface 46 of shank 42.

When the handle 40 is mounted in this alternate mode illustrated in FIG. 8, the handle extends rearwardly and upwardly from the shield 20 with the longitudinal axis of the handle grip 49 extending at an angle of approximately 120° from the plane of the shield 20. The alternate mounting is very useful for some applications, such as in use of the shield along baseboards or at the bottom of walls where the user must work in a stopping position or in tight configurations.

Figure 9:
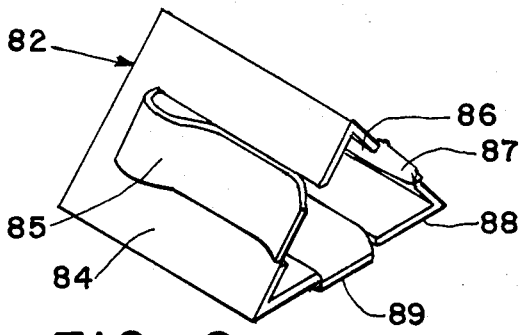
FIG. 9 is a perspective view of an alternate end clip used for maintaining the structure of the reinforcing rib.
Figure 10:
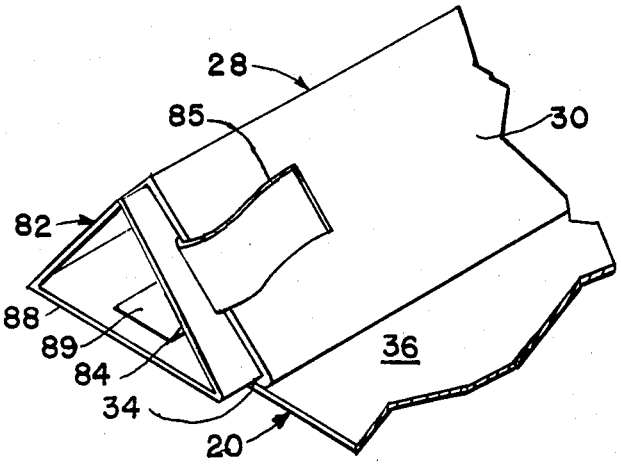
FIG. 10 is a perspective view of the alternate embodiment retainer clip of FIG. 9 shown in use position attached to the reinforcing rib.

An alternate embodiment end clip 82 is illustrated in FIG. 9 as an alternative to the clip 80 shown in FIG. 7. This end clip is an equilateral triangular structure having three equal sides 84, 86, 88. Each side has a resilient clip 85, 87, 89, respectively, formed therein. The equilateral triangular structure of clip 82 is sized to slide into the equilateral triangular shaped rib 28 as shown in FIG. 10. The clips 85, 87, 89 extend over the respective sides of panels of the rib 28, with the bottom clip 89 clamping the inside flap 34 of the rib structure to the shield 20.

Figure 11:
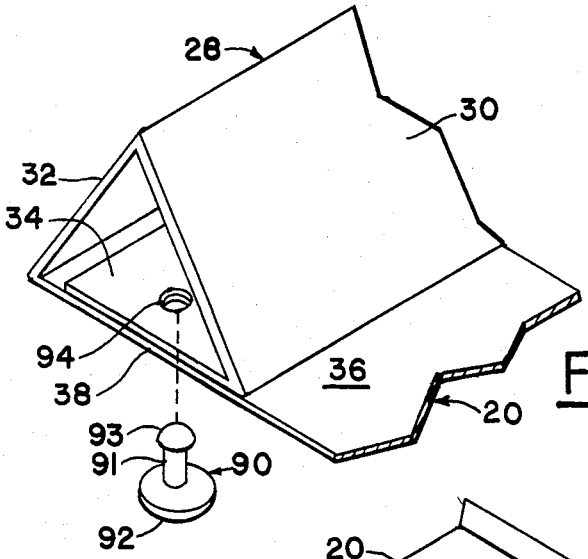
FIG. 11 is a perspective view of the reinforcing rib with another alternate structural retainer in the form of a resilient, deformable rubber pin.

Another alternate embodiment retainer 90 is shown in FIG. 11. In this embodiment, the retainer 90 is comprised of a resilient rubber or plastic pin 91 with a head 92 at one end and a deformable retainer 93 at the opposite end. The deformable retainer 93 is forced through holes 94 in the inside flap 34 and in the shield 20. In this manner, when the retainer 90 is inserted in the holes 94, the head 92 bears against the bottom surface 38 of shield 20 and the retainer 93 bears against the top surface of the inside flap 34 to retain the shape and structural configuration of the triangular rib 28.

Other retainer devices, such as an adhering surface, double-sided adhesive tape, and the like (not shown) can also be used to fasten the inside panel 34 to the shield 20 in the configuration described above to retain the structure of the rib 28.

Figure 12:
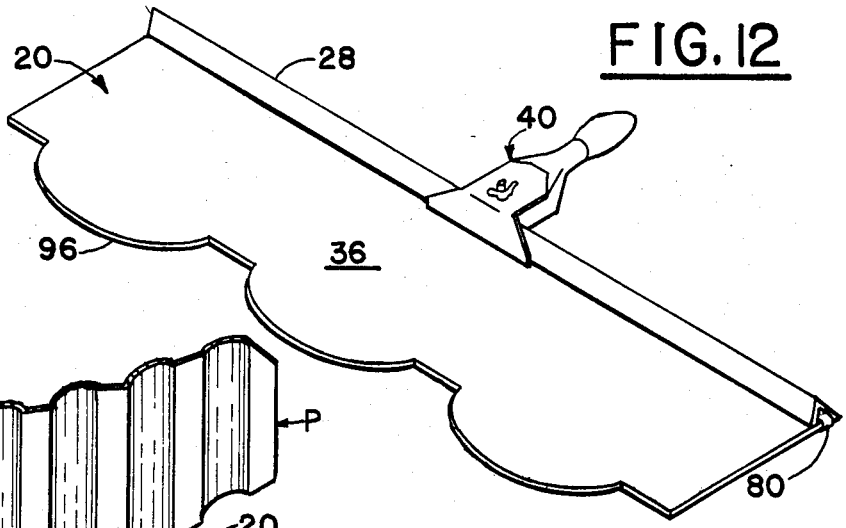
FIG. 12 is a perspective view of the paint shield according to this invention illustrating a custom cut leading or cutting edge thereon.
Figure 13:
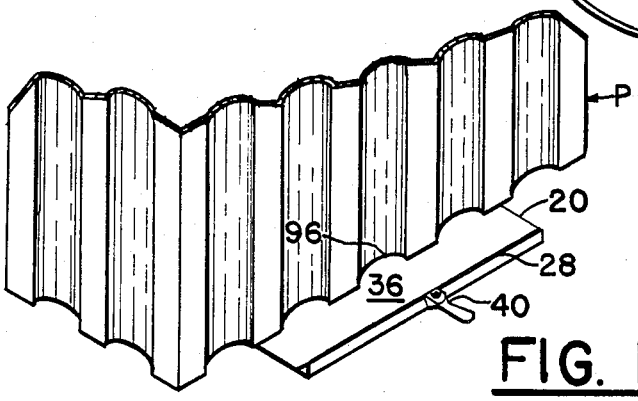
FIG. 13 is a perspective view of the spray shield shown in FIG. 12 illustrating its use in protecting the floor surface along the base of a corrugated building wall.

The illustrations in FIGS. 12 and 13 show another specialized configuration and usage for the disposable spray shield 20 of the present invention. In this configuration, the front or leading edge 96 of the shield 20 is custom-shaped to fit or correspond to irregularities or curved surfaces in the wall being painted. This disposable shield 20, according to this invention, is conducive to this kind of specialized, one-time use because of the materials used in its construction, such as inexpensive cardboard, that is provided with the necessary structural rigidity by the formation of the rib 28. Because the materials are inexpensive and disposable, special projects such as this can be accommodated by custom-shaping and cutting the leading edge 96 to the shape desired, using the shield for that particular job, and then disposing of it. This kind of specialized, custom job usage is not available in any practical sense with the conventional, more expensive metal shields available in the prior art.

Figure 14:
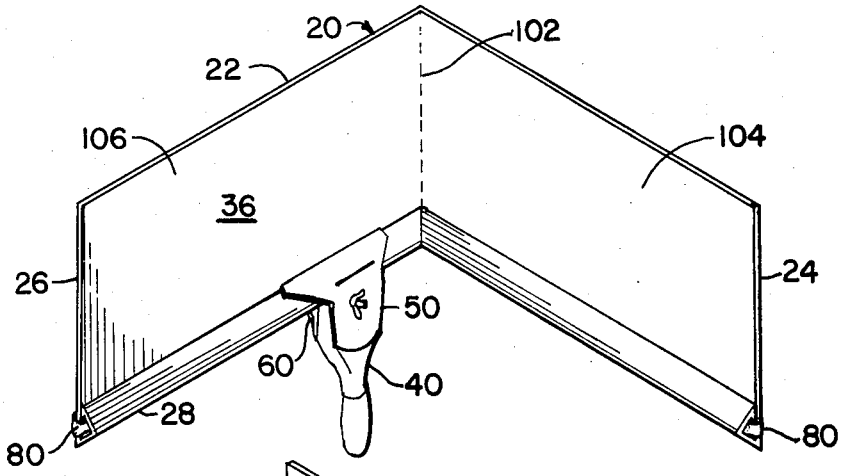
FIG. 14 is a perspective view of the disposable paint shield of the present invention formed with a right angle bend therein for use in shielding adjacent wall surfaces where they intersect with a ceiling.
Figure 15:
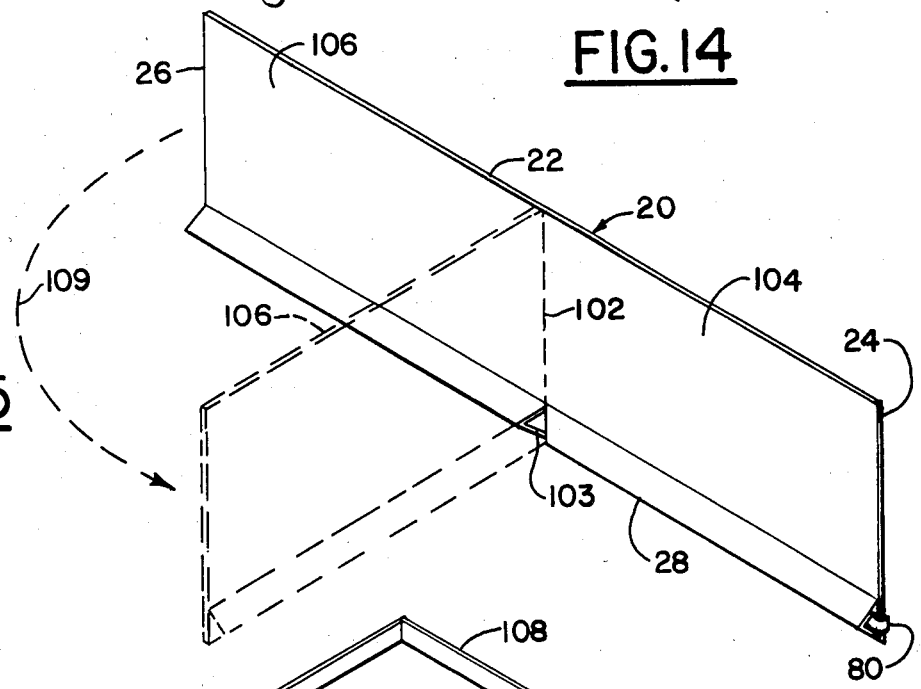
FIG. 15 is a perspective view of the disposable shield of FIG. 14 illustrating its formation into the corner configuration.
Figure 16:
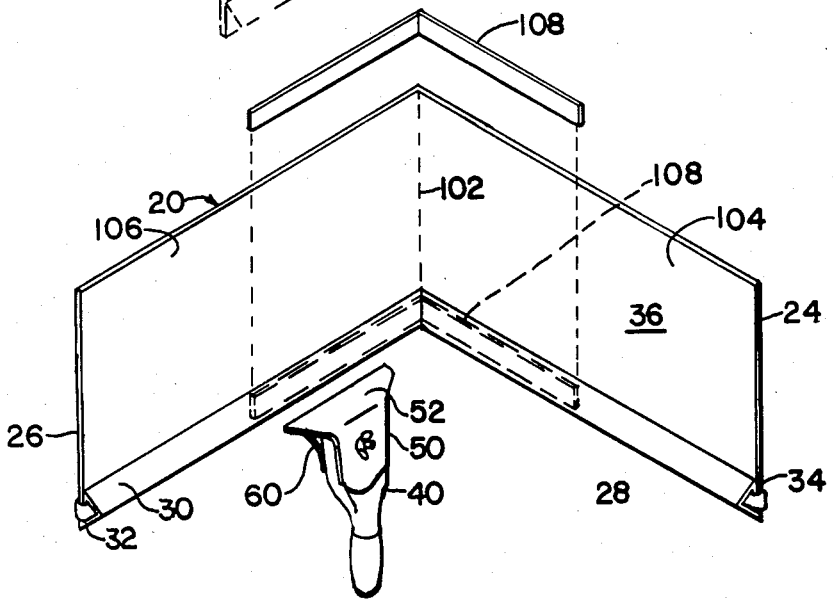
FIG. 16 is a perspective view of the disposable shield of FIGS. 14 and 15 illustrating a reinforcing member for the corner and the handle as it is about to be attached.

Another alternate embodiment is illustrated in FIGS. 14, 15 and 16. In this embodiment, the shield 20 is bent along a line 102 into two sections 104, 106 at right angles to each other. In this configuration, the shield can be used to shield portions of adjacent walls where they join a ceiling as the ceiling is being painted or textured. In order to form the shield 20 into this configuration, a 45° notch 103 is cut in the rib 28 about midway between the right and left edges 24, 26, respectively, as shown in FIG. 15. Then, one section, such as left section 106, is rotated about the fold line 102, as indicated by arrow 109, to the position 106' shown in phantom lines. Then a rigid retainer bar 108 formed in the configuration of a right angle, is inserted into the rib 28 between the upper surface 36 of shield 20 and the inside flap 34 of the rib 28, as illustrated in phantom lines 108'. With the rigid retainer bar 108 positioned in the rib 28, as shown at 108', the handle 40 can be attached to the rib 28, as described above for the preferred embodiment. When so assembled, the handle 40 holds the rib 28 with retainer bar 108 therein, in their assembled positions and configurations for use. When the shield 20 is assembled in this manner as illustrated in FIGS. 14 through 16, it provides a very structurally rigid, yet light-weight disposable shield that is usable in a corner at the intersection where two walls meet a ceiling.

Figure 17:
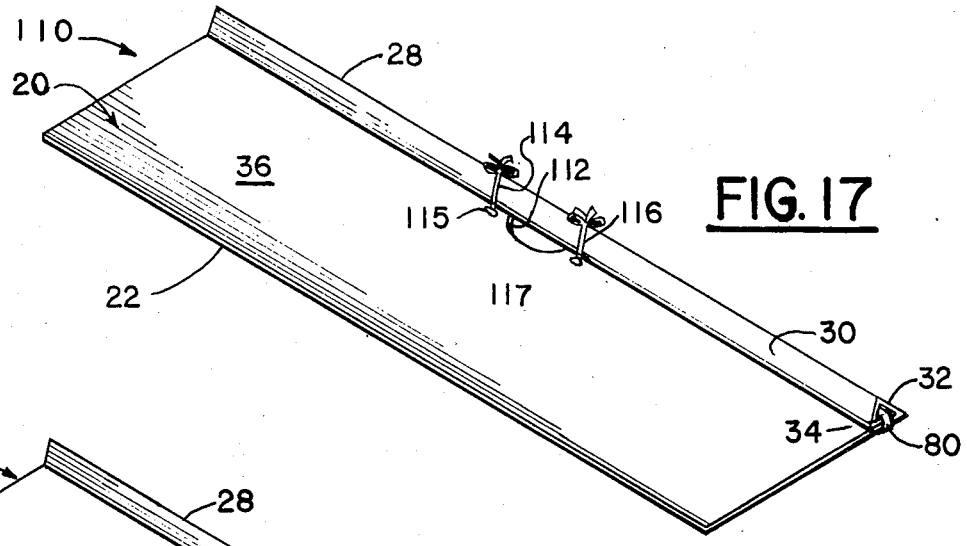
FIG. 17 is a perspective view of another embodiment of the invention showing the spray shield according to the present invention wherein the web is used as a handle.

In the embodiments described above, the shield 20 is intended to be disposable, while the handle 40 is intended to be used over and over again with new disposable shields 20. However, the disposable shield 20 according to this invention is also conducive to use without a more expensive detachable permanent handle 40. Such an embodiment 110 is illustrated in FIG. 17. In this embodiment, the planar shield 20 is formed as described above with a rib 28 at its rear edge to provide structural rigidity. However, instead of the handle 40, a hand hole 112 is cut into the rear portion of the shield 20 adjacent the rib 28 to provide access for a person's fingers (not shown) to curl around and grasp the rib 28. In this manner, the rib 28 itself becomes the handle. The structural configuration of the rib 28 can be retained by the use of ties or wires 114, 116 extending through holes 115, 117, respectively, in the shield 20. These ties can be wrapped around the rib 28 to retain its structure during use. Also, as described in the embodiments above, the clip 80 can be inserted into the ends of the rib 28 to maintain its structural configuration at the outside ends.

Figure 18:
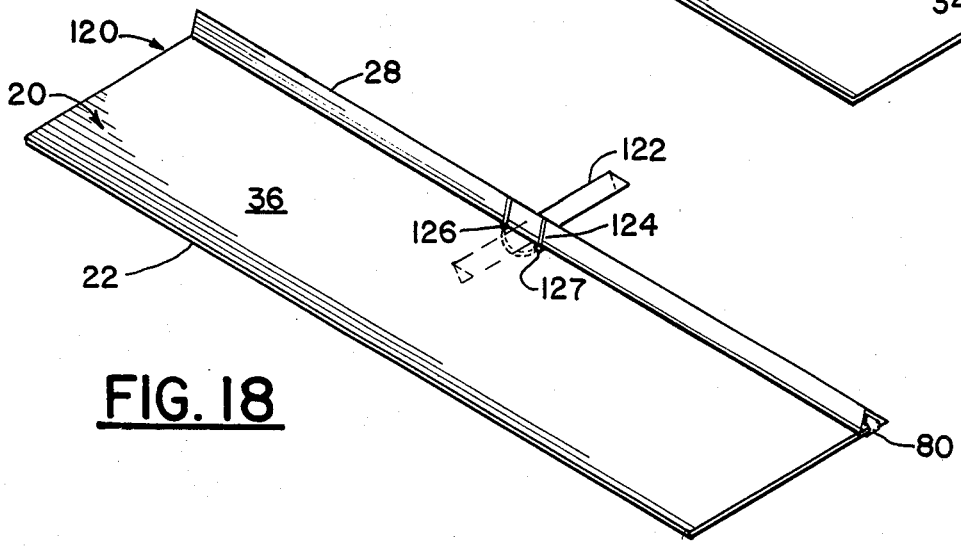
FIG. 18 is another alternate embodiment of the spray shield of the present invention including a disposable handle attached thereto.

The embodiment 120 as illustrated in FIG. 18, is also constructed with a rib 28, similar to those embodiments described above. However, this embodiment also includes a disposable handle 122 that is also constructed of an inexpensive, semi-rigid material, such as cardboard, formed into a triangular configuration for structural rigidity. A tie 124 extending through holes 126, 127 in the shield 20 and wrapped around both the handle 122 and the rib 28 retains the handle 122 in attachment to the shield 20.

Figure 19:
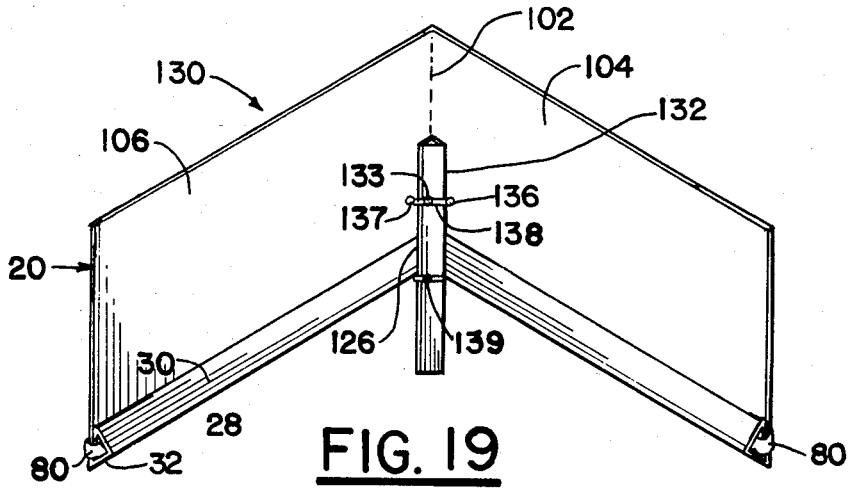
FIG. 19 is another embodiment of the present invention formed into a right angle similar to that in FIG. 14, but with a disposable handle attached thereto.

A disposable handle similar to that described in embodiment 120 of FIG. 18 can also be used in the right angle corner shield configuration 130, as illustrated in FIG. 19. In this embodiment, the shield 20 is bent into two sections 104, 106 at right angles to each other, and the disposable handle 132 having a triangular configuration, preferably with a right angle at the apex of the triangle positioned along the bend line 102. A tie 138 extends through respective holes 136, 137 and respective sections 104, 106 and through a center hole 133 in the handle to fasten the handle to the shield 20. This tie 138 also extends around the rear side of the rib 28 and through another hole 139 in the handle 132 to further secure the handle 132 to the shield 20.

While these embodiments illustrated in FIGS. 17 through 19 are not as structurally rigid and desirable as the more permanent reusable handle 40 of the preferred embodiment, they do have the advantage of providing a completely disposable shield apparatus that is very usable and does not require the investment of a more expensive handle. These completely disposable shields illustrated in FIGS. 17 through 19 are more conducive to amateur usage where a person might only desire the temporary use of shields for a small job, whereas professionals may desire the more permanent handle 40 of the preferred embodiment described above.

All of these embodiments can be provided with basically one shield structure. The fold lines, such as the lines 31, 33, 35 shown in FIG. 6, as well as the cut-out lines 112 shown in FIG. 17 and bend lines shown in FIGS. 15 and 19 can be imprinted or scored into the shield structure 20. Then, the end user can use whichever of these bends or lines he desires for the particular shield design and structure is conducive to use in this variety of alternate embodiments.

Figure 20:
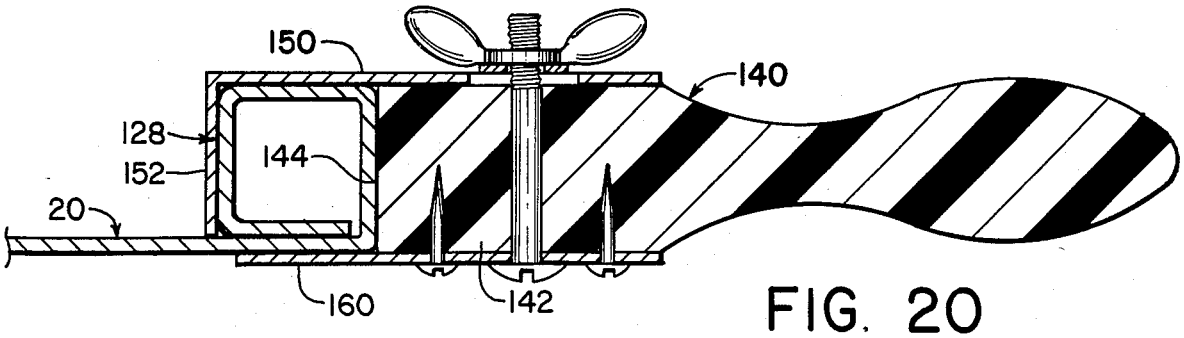
FIG. 20 is a cross-sectional view of the spray shield and handle combination showing stiffener rib with a square cross-sectional configuration stiffener rib.

All of the embodiments of this invention described above have been illustrated with the rib 28 formed into a structural configuration having an equilateral triangular cross section. While such equilateral triangular crosssection is the preferred structure and has a number of advantages as described above, stiffening ribs for the rear edge of the spray shield 20 can also be formed in a variety of other geometric configurations as well. For example, the variation illustrated in FIGS. 20 and 21 utilize a reinforcing rib 128 at the rear edge of shield 20 having the shape of a rectangular or square cross-section. In this embodiment, the shank 142 of handle 140 is modified from that described above to have a flat front fact 144 positioned at right angles to the top and bottom retainer plates 150, 160, respectively. The top plate 150 has a forward portion 152 that is turned downwardly at a right angle to the top plate 150 with its distal end terminating adjacent the top surface of the disposable shield 20. This structure of handle 140 is particularly adapted to clamp and retain therein the stiffener rib 128 of the shield 20 formed in a configuration having a square or rectangular cross section. As will be appreciated from the description for the preferred embodiment above, this square cross-section can be formed adjacent the rear edge of the shield 20 by bending the material of the shield 20 into four distinct strips to form the four sides of the square or rectangular.

Figure 21:
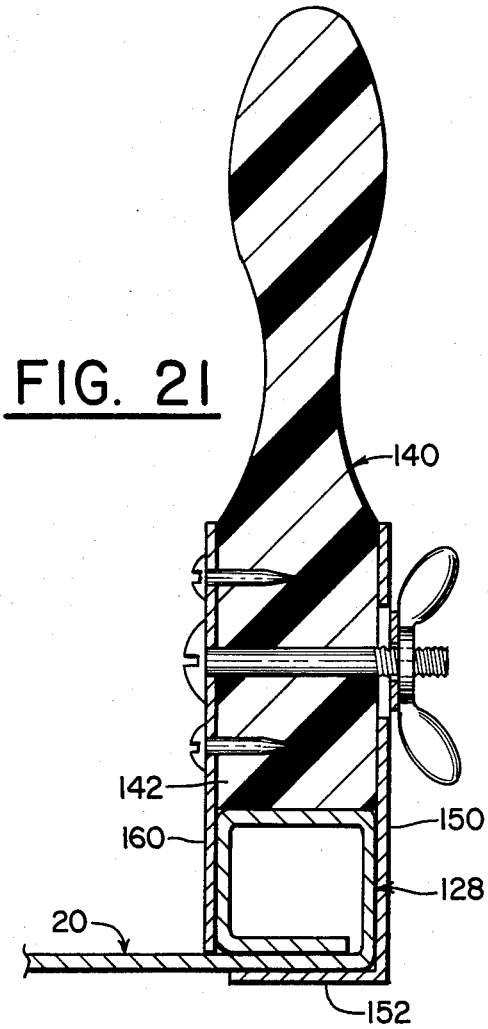
FIG. 21 illustrates a reverse mounting of the handle shown in Figure 20.

Similar to the preferred embodiment handle 40 described above, this alternate embodiment handle 140 can be mounted in a reverse manner, as shown in FIG. 21. In this mounting position, the handle 140, instead of extending coplanar with the shield 20, extends upwardly perpendicular to the plane of the shield 20. This alternative mounting may be desirable for use of the shield in some tight spaces or positions that would otherwise be awkward to the user.

Figure 23:
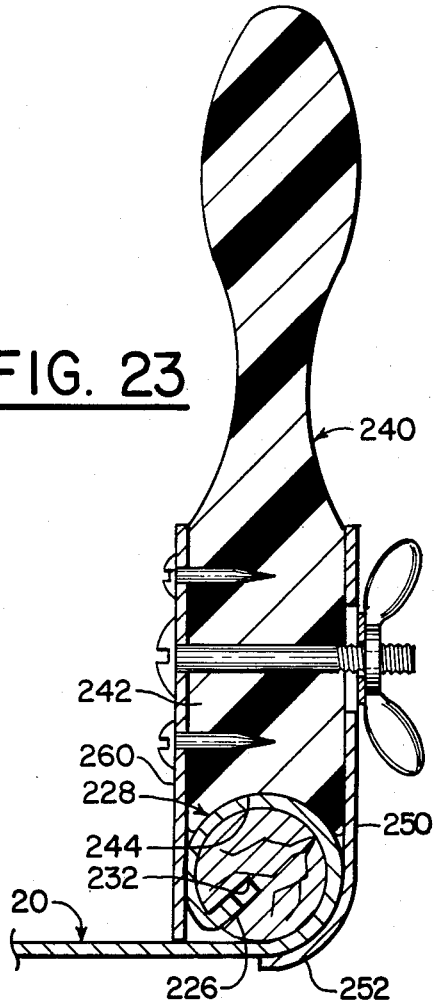
FIG. 23 is an illustration of the reverse mounting of the handle of FIG. 22.
Figure 22:
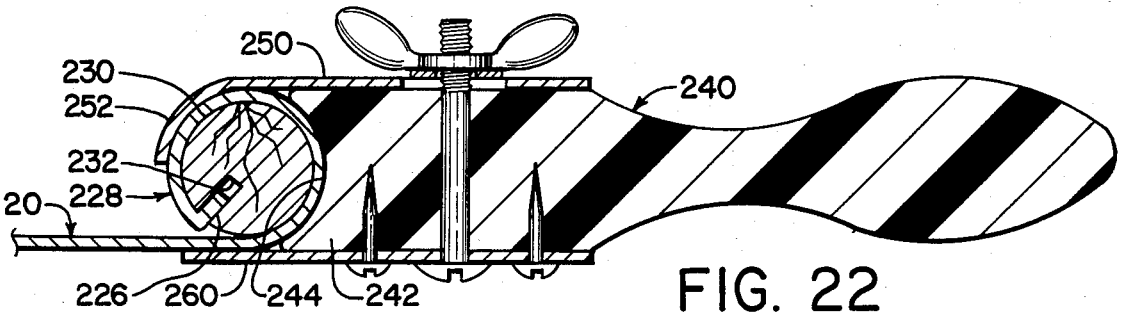
FIG. 22 is a cross-sectional view of another spray shield and handle variation having a stiffener rib with a circular cross-sectional configuration.

Another variation of this invention illustrated in FIGS. 22 and 23 discloses the use of a stiffener rib 228 on shield 20 having a circular crosssectional configuration. In this variation, the shank 242 of handle 240 has a concave front face 244 between the top and bottom plates 250, 260, respectively. The distal portion 262 of top plate 250 is curved downwardly in a quarter circle to securely clamp the circular shaped rib 228 into the handle 240. More or less of the circular cross section can be enclosed; however, there should be less than 180° between support or clamping points to prevent the rib 228 from coming out of the grip of handle 240. As shown in FIG. 23, the handle 240 can also be mounted on the shield 20 in a reverse manner so that it extends upwardly from the plane of shield 20 rather than longitudinally from the plane of shield 20, as shown in FIG. 22.

Figure 24:
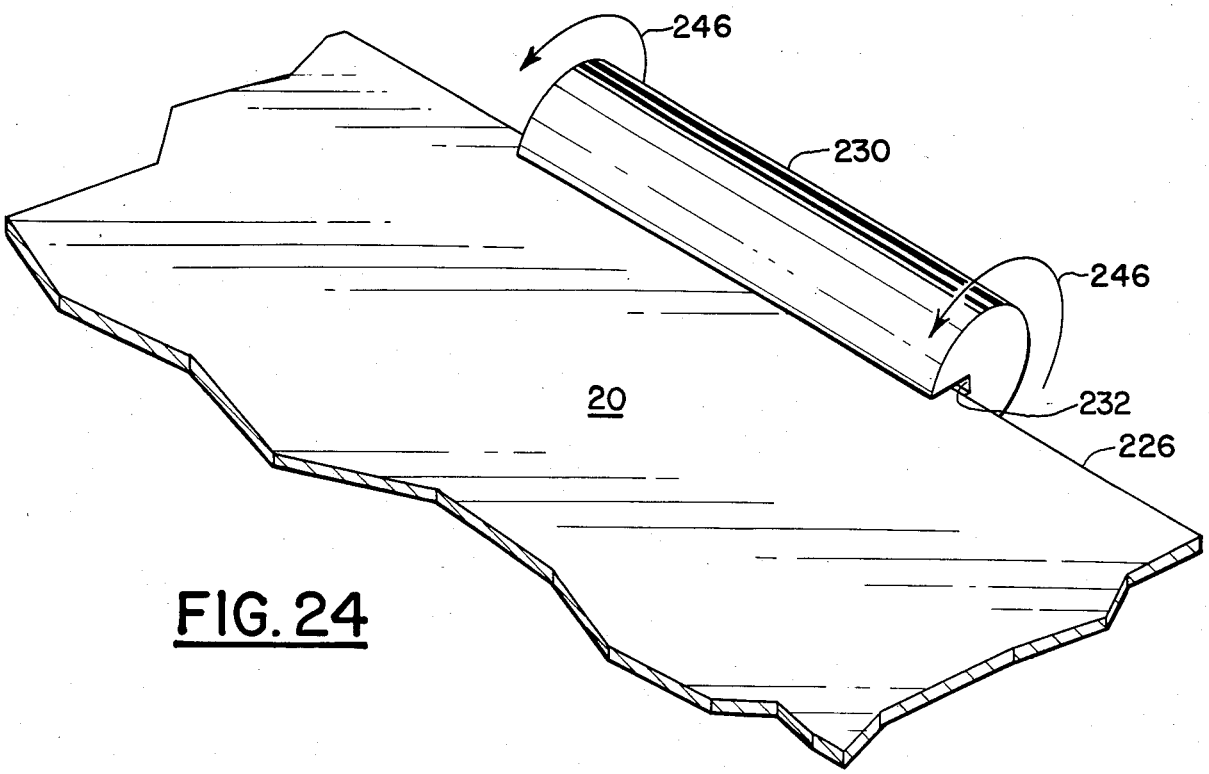
FIG. 24 is an isometric view of a forming block used to form the stiffener ribs of the invention.

It is appropriate at this point to describe another feature of this invention that can be used to form the stiffener rib on the shield 20 with use of a rigid forming block 230, as shown in FIG. 24. The forming block illustrated in FIG. 24 has an elongated cylindrical shape and is used to form a rib having a circular cross-section, such as that illustrated in FIGS. 22 and 23. An elongated slot 232 extends inwardly from the peripheral surface of forming block 230 along its entire length. This slot 232 is sized and shaped to receive therein the rear edge 226 of the shield 20. Then, with the rear ege 226 securely positioned in the slot 232, the forming block 230 can be rolled as illustrated by the arrows 246 over the top surface of the shield 20 to form the stiffener rib 228 that is shown in FIGS. 22 and 23. Then, as further illustrated in FIGS. 22 and 23, this forming block 230 can be clamped into the handle 240 along with the stiffener rib 228 of shield 20. When the forming block 230 is clamped into the handle 240 in this manner, it further assists in retaining the structural configuration of the rib 228 during the use of the shield 20, thus adding to the durability of the shield 20.

While the preferred length of the forming block 230 is approximately equal to the width of the top and bottom plates 250, 260, respectively of the handle 240. However, it can be utilized in longer lengths if desired. In fact, in some situations, a longer forming block 230 left inside the rib 228 could further increase the stiffness and durability of a disposable shield 20.

Referring again to FIG. 22, the rear edge 226 of the shield 20 is left inserted in the slot 232 in forming block 230. However, at the outer ends of the rib 228, or the forming block 230 does not extend to the outer ends that portion 226 can be secured to the top surface of the shield 20 by use of clips 80 in the manner described above and illustrated in FIGS. 7 through 19.

It is also appropriate to mention that while the forming block 230 is illustrated for purposes of description herein in the form of an elongated cylinder for forming a rib 228 having a circular cross-section, forming ribs can also be shaped with a polygonal cross-section. For example, it could have a triangular cross-section for use in forming the triangular rib 228 described in FIGS. 1 through 19 above, or it could have a rectangular or square cross-section for forming the rib 128 described in FIGS. 20 and 21 above. While the forming block will not be mentioned in the description hereafter of additional variations of this invention, it can be shaped to form any of those rib configurations to be described, as well as others that will become obvious from the description of this invention. It is also appropriate to mention that such a forming block in any desired cross-sectional configuration could be used advantageously in embodiments in this invention such as that described in FIG. 17, wherein the handle is formed by the rib 28 itself in combination with an opening or hole 112 to facilitate grasping of the rib 28.

Figure 26:
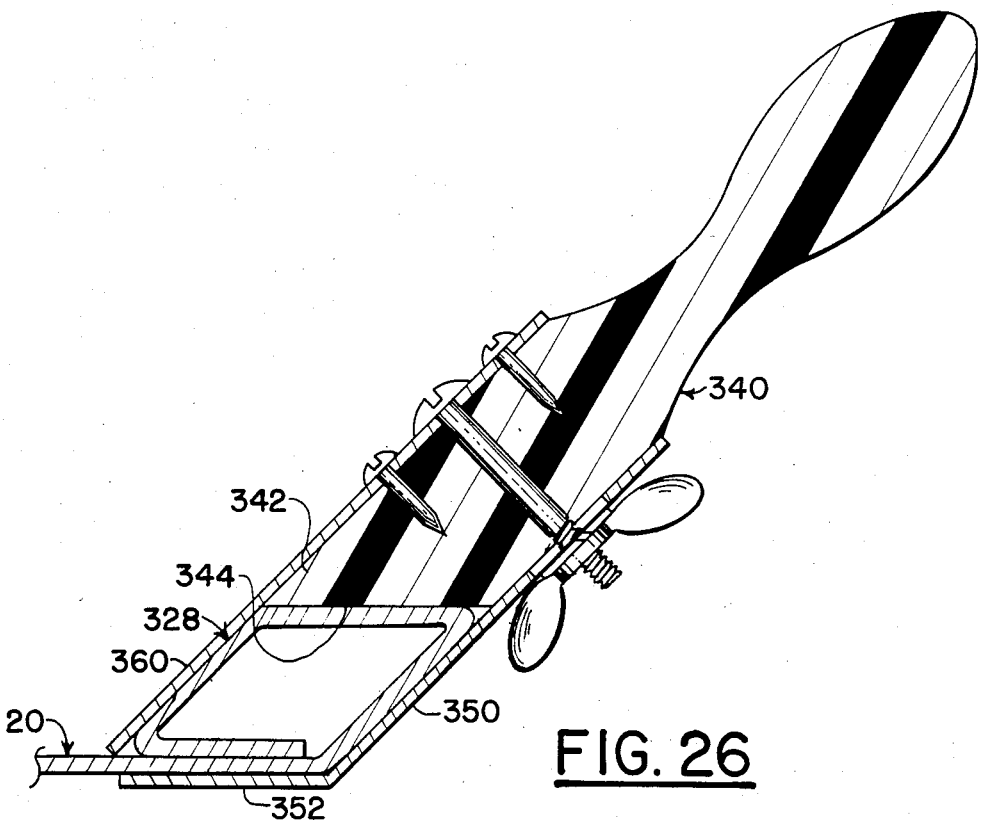
FIG. 26 illustrates the handle of FIG. 25 with the shield attached at an angular orientation.
Figure 25:
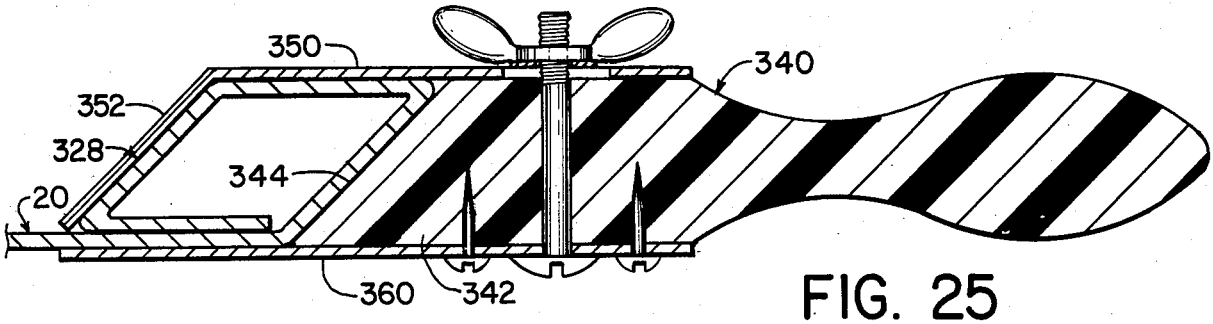
FIG. 25 is a cross-sectional view of another variation of the spray shield and handle combination illustrating a stiffener rib cross section in the shape of a parallelogram.

Another variation of handle and rib structure according to this invention is shown in FIGS. 25 and 26, wherein the stiffener rib 328 has a cross-sectional shape in the geometric configuration of a parallelogram. In this variation, the shank 342 of handle 340 has a front face 344 that is slanted at an acute angle to the forwardly protruding portion of top plate 350 and at an obtuse angle to the forwardly protruding portion of bottom plate 360. These angles are preferably 45° and 135° respectively, although they can be at any selected combination of angles desired. The top plate 350 is turned downwardly in a portion 352 toward shield 20 in a plane that is preferably parallel to the plane of the front face 344. In this variation, as illustrated in FIG. 26, the handle 340 can be reversed to extend upwardly at a 45° angle to the plane of shield 20, if desired for particular applications.

Figure 27:
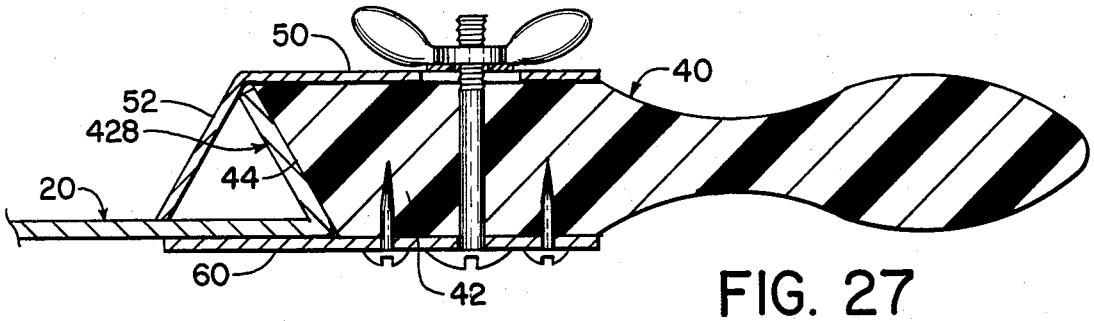
FIG. 27 illustrates the handle of FIG. 5 utilized to retain another stiffener rib variation.
Figure 28:
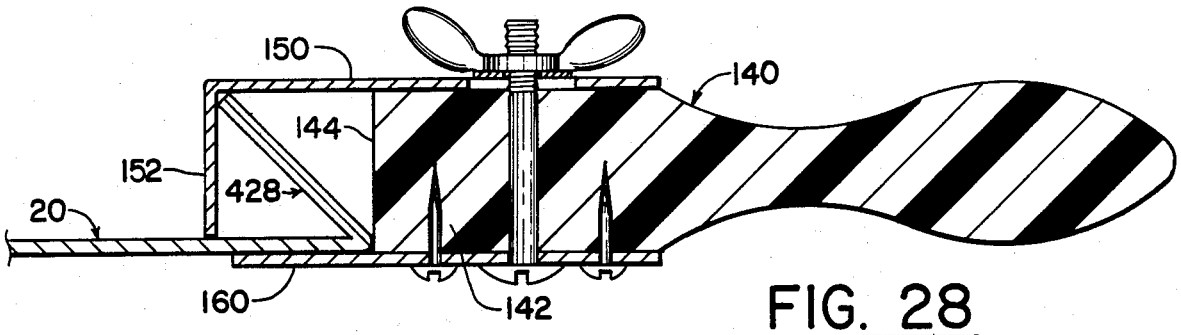
FIG. 28 illustrates the handle of FIG. 20 utilized for retaining a variation of the stiffener rib.
Figure 29:
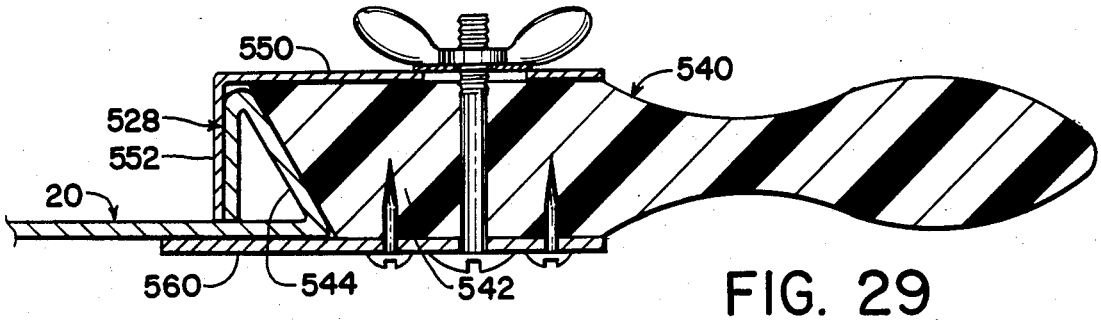
FIG. 29 illustrates another spray shield and handle variation with a stiffener rib formed with a cross section in the shape of a right triangle.

There are numerous other configurations of stiffener ribs and handle combinations that can be formed according to this invention. It is not practical or necessary to illustrate or disclose all of the possibilities; however, FIGS. 27 through 29 illustrate several of them. For example, the handle 40 of the preferred embodiment illustrated in FIGS. 5 and 8 is shown in FIG. 27 with a rib variation 428 being formed with only two sides of an equilateral triangle clamped between the top plate 50 and bottom plate 60. A similar two-sided rib 428 is illustrated in FIG. 28 clamped in the handle 140 that was illustrated in FIGS. 20 and 21 for rectangular or square ribs. While these two-sided stiffener ribs obviously are not as durable as the polyhedronal or cylindrical ribs described above, they are within the scope of this invention for forming disposable spray shields from inexpensive planar sheets of semi-rigid material.

The handle 540 in FIG. 29 illustrates a configuration used to hold a spray shield 20 having a rib 528 constructed with a right, triangular configuration. In this variation, the front portion 552 of top plate 550 is turned downwardly at a right angle adjacent the shank 542. The front face 544 of shank 542 can be at any desired angle to the top and bottom plates 550, 560, respectively.

Any of the stiffener rib configurations described above can be utilized either with handles, as shown in the respective drawings, or in a manner similar to that illustrated in FIGS. 17 through 19 for applications where a more permanent or durable handle is not desired. Therefore, it should be appreciated that all of the variations described above can be used in combination with each of the other embodiments or combinations described herein as desired.

The foregoing is considered as illustrative only of the principals of the invention. Further, since numerous modifications and changes will readily occur to those skilled in the art, it is not desired to limit the invention to the exact construction and operation shown and described, and accordingly, all suitable modifications and equivalents may be resorted to falling within the scope of the invention as defined by the claims which follow.

We claim:

1. Disposable spray shield apparatus comprising:
a thin, rigid, planar sheet having a top surface and a bottom surface as well as front, rear, and side edges, the rear edge of which has formed thereon thickened rib means for enhancing structural support and resistance to deformation of the planar sheet, and handle means structured for removable attachment to, and engagement with, said rib means for supporting and holding said planar sheet, said thickened rib means being formed with the rear edge portion of said sheet bent out of the plane of the sheet in at least one different plane that is at an angle less than 180° to the plane of said sheet.

2. The disposable spray shield apparatus of claim 1, wherein said thickened rib means has a parallelogram-shaped cross-sectional configuration.

3. The disposable spray shield apparatus of claim 2, wherein said thickened rib means has a rectangular-shaped cross-sectional configuration.

4. The disposable spray shield apparatus of claim 3, wherein said rectangular cross-sectional configuration is square.

5. The disposable spray shield apparatus of claim 2, wherein said removable handle means includes releaseable clamping means for engaging all sides of said parallelogram-shaped rib.

6. The disposable spray shield apparatus of claim 1, wherein said thickened rib means is has a triangular-shaped cross-sectional configuration.

7. The disposable spray shield apparatus of claim 6, wherein said removable handle means includes releaseable clamping means for engaging all three sides of said triangular-shaped rib.

8. The disposable spray shield apparatus of claim 1, including rib shape forming means for forming said thickened rib means on said sheet, said rib shape forming means including an elongated polyhedron body having a polygonal cross-section and an elongated slot extending into one side of the body along the length of said one side with said rear edge of said sheet being inserted into said slot.

9. Disposable spray shield apparatus, comprising:
a thin, rigid, planar sheet having a top surface and a bottom surface as well as front, rear, and side edges, the rear edge of which has formed thereon thickened rib means for enhancing structural support and resistance to deformation of the planar sheet, and removable handle means structured for removable attachment to, and engagement with, said rib means for supporting and holding said planar sheet, said thickened rib means being formed with the rear edge portion of said sheet bent out of the plane of the sheet and returned over the plane of the sheet to form a cylinder.

10. The disposable spray shield apparatus of claim 9, wherein said removeable handle means includes releaseable clamping means for engaging said cylindrical rib at a plurality of points on said rib less than 180° from each other.

11. The disposable spray shield apparatus of claim 9, including rib shape forming means for forming said thickened rib on said sheet, said rib shape forming means including an elongated cylindrical body with an elongated slot extending into the side of the body along the length of the side with said rear edge of said sheet being inserted into said slot.

12. Disposable spray shield apparatus, comprising:

a thin, rigid, planar sheet having a top surface and a bottom surface as well as front, rear, and side edges, the rear edge of which has formed thereon thickened rib means for enhancing structural support and resistance to deformation of the planar sheet, said thickened rib means being formed with the rear edge portion of said sheet bent out of the plane of the sheet and returned over the plane of the sheet with at least part of said returned portion being positioned at a distance spaced above said plane, and said sheet having a hole therethrough adjacent said thickened rib means large enough for insertion therethrough of a user's fingers for grasping said thickened rib means.

13. Disposable spray shield apparatus, fabricated by the method comprising the steps of:

bending a portion of a thin, semi-rigid planar sheet adjacent one edge of the sheet out of the plane of the sheet and returning the bent portion over the sheet so that at least some of said bent portion is positioned a distance spaced above said plane to form a three-dimensional structural rib having a cross section that is not in the shape of an equilateral triangle; and clamping the panels of the rib in this three-dimensional configuration.

14. The disposable spray shield of claim 13, including the step of clamping a handle on said rib to hold the shape of said three-dimensional configuration and to provide a convenient gripping and holding protrusion for holding and manipulating the shield.

15. The disposable spray shield of claim 13, including the step of perforating a hole through said planar sheet adjacent said rib large enough for a person's fingers to curl therethrough and around said rib.

16. The disposable spray shield of claim 13, including the steps of cutting a wedge out of the midportion of said rib to form a notch in said rib with one section of the planar sheet on one side of the notch and the other section of the planar sheet on the other side of the notch, folding said one section of said planar sheet toward said other section to a desired angular relationship therebetween, forming a rigid, elongated member to have an angular edge that matches said desired angle between said sections, inserting said rigid member into said notch in said rib between said sections of said planar sheet, and clamping said rib together with said rigid member therein.

17. The disposable spray shield of claim 13, including the step of shaping the edge of said planar sheet opposite said rib to a desired pattern corresponding with the shape of a surface to be sprayed.

18. The disposable spray shield apparatus of claim 13, including the step of bending said rib portion of said sheet out of the plane of the sheet and returning it over the plane of the sheet in at least one different plane that is at an angle less than 180° to the plane of said sheet.

19. The disposable spray shield apparatus of claim 18, including the step of bending said portion into the shape of a polyhedron.

20. The disposable spray shield apparatus of claim 19, including the step of bending said portion into a rib having a parallelogram-shaped cross-sectional configuration.

21. The disposable spray shield apparatus of claim 20, including the step of bending said portion to have a rectangular cross-sectional configuration.

22. The disposable spray shield apparatus of claim 21, including the step of bending said portion to have a square cross-sectional configuration.

23. The disposable spray shield apparatus of claim 20, including the step of releaseably clamping all four sides of said parallelogram-shaped rib into a handle.

24. The disposable spray shield apparatus of claim 18, including the step of bending said portion into a triangular-shaped cross-sectional configuration.

25. The disposable spray shield apparatus of claim 24, including the step of releaseably clamping all three sides of said triangular-shaped rib.

26. The disposable spray shield apparatus of claim 13, including the steps of forming an elongated slot in an elongate polyhedron, inserting said one edge of said sheet into said slot, and forming said three-dimensional structure by rolling said portion of said planar sheet around the peripheral surface of said polyhedron.

27. The disposable spray shield apparatus of claim 13, including the steps of forming an elongated slot in an elongated cylinder, inserting said one edge of said sheet into said slot, and forming said three-dimensional structure by rolling said portion of said planar sheet around the peripheral surface of said cylinder.

28. The disposable spray shield apparatus of claim 13, including the step of bending said portion of said sheet out of the plane of the sheet and returning it over the plane of the sheet to form a cylinder.

29. The disposable spray shield apparatus of claim 28 including the step of releaseably clamping a handle onto said cylindrical rib at a plurality of points on said rib less than 180° from each other.

30. The disposable spray shield apparatus of claim 28, including the step of forming a hole through said sheet adjacent said structural rib large enough for insertion of a user's fingers through the hole for grasping said structural rib.

* * * * *